US006571887B1

(12) United States Patent
Nguyen et al.

(10) Patent No.: US 6,571,887 B1
(45) Date of Patent: Jun. 3, 2003

(54) DIRECTIONAL FLOW NOZZLE RETENTION BODY

(75) Inventors: Quan V. Nguyen, Houston, TX (US); James L. Larsen, Spring, TX (US); Michael A. Siracki, The Woodlands, TX (US); Chris E. Cawthorne, The Woodlands, TX (US)

(73) Assignee: SII Smith International, Inc., Houston, TX (US)

( * ) Notice: Subject to any disclaimer, the term of this patent is extended or adjusted under 35 U.S.C. 154(b) by 0 days.

(21) Appl. No.: 09/547,691

(22) Filed: Apr. 12, 2000

(51) Int. Cl.[7] ..... E21B 10/18
(52) U.S. Cl. ..... 175/57; 175/340; 175/424
(58) Field of Search ..... 175/340, 339, 175/393, 424, 57

(56) References Cited

U.S. PATENT DOCUMENTS

| | | | | | |
|---|---|---|---|---|---|
| 4,082,015 | A | | 4/1978 | Craig | 76/108 |
| 4,378,853 | A | * | 4/1983 | Chia et al. | 175/340 |
| 4,516,642 | A | | 5/1985 | Childers et al. | 175/340 |
| 4,542,942 | A | * | 9/1985 | Zitz et al. | 175/393 |
| 4,546,837 | A | | 10/1985 | Childers et al. | 175/340 |
| 4,558,754 | A | | 12/1985 | Childers et al. | 175/340 |
| 4,582,149 | A | * | 4/1986 | Slaughter, Jr. | 175/340 |
| 4,611,673 | A | * | 9/1986 | Childers et al. | 175/340 |
| 4,711,311 | A | * | 12/1987 | Underwood et al. | 175/340 |
| 4,741,406 | A | | 5/1988 | Deane et al. | 175/340 |
| 4,776,412 | A | | 10/1988 | Thompson | 175/393 |
| 4,794,995 | A | | 1/1989 | Matson et al. | 175/393 |
| 4,848,476 | A | | 7/1989 | Deane et al. | 175/340 |
| 4,886,131 | A | * | 12/1989 | Cholet et al. | 175/340 |
| 4,989,680 | A | | 2/1991 | Deane et al. | 175/340 |
| 5,029,656 | A | | 7/1991 | Ivie et al. | 175/340 |
| 5,096,005 | A | | 3/1992 | Ivie et al. | 175/340 |
| 5,145,016 | A | * | 9/1992 | Estes | 175/331 |
| 5,601,153 | A | * | 2/1997 | Ensminger et al. | 175/340 |
| 5,669,459 | A | | 9/1997 | Larsen et al. | 175/340 |

FOREIGN PATENT DOCUMENTS

| | | | |
|---|---|---|---|
| GB | 2 328 234a | 2/1999 | E21B/10/60 |

OTHER PUBLICATIONS

UK Search Report for British Application No. GB 0109304.6 dated Aug. 23, 2001; (2 p.).

*Magnum Rock Bits*; Smith Tool, a Business Unit of Smith International, Inc.; 1998;(16 p.).

* cited by examiner

*Primary Examiner*—Hoang Dang
(74) *Attorney, Agent, or Firm*—Conley Rose, P.C.

(57) ABSTRACT

A drill bit having one or more nozzle retention bodies attached by a single orientation mounting is disclosed, as is the associated method for its manufacture. The upper end of the nozzle retention body has a fluid inlet in communication with the internal fluid plenum of the drill bit, and the lower end of the nozzle retention body includes a fluid outlet that defines an exit flow angle. The exit flow angle is angularly disposed from the longitudinal axis of the drill bit. The nozzle retention body may advantageously be chamfered or the like to provide a reduced cross-sectional area at the lower end of the nozzle retention body. The outer surface of the nozzle retention body (and attached hardened elements) may extend substantially to gage, or may fall short of that diameter.

26 Claims, 11 Drawing Sheets

DIRECTIONAL FLOW NOZZLE RETENTION BODY

CROSS-REFERENCE TO RELATED APPLICATION

None.

BACKGROUND OF THE INVENTION

Roller cone bits, variously referred to as rock bits or drill bits, are used in earth drilling applications. Typically, these are used in petroleum or mining operations where the cost of drilling is significantly affected by the rate that the drill bits penetrate the various types of subterranean formations. There is a continual effort to optimize the design of drill bits to more rapidly drill specific formations so as to reduce these drilling costs.

One design element that significantly affects the drilling rate of the rock bit is the hydraulics. As they drill, the rock bits generate rock fragments known as drill cuttings. These rock fragments are carried uphole to the surface by a moving column of drilling fluid that travels to the interior of the drill bit through the center of an attached drill string, is ejected from the face of the drill bit through a series of jet nozzles, and is carried uphole through an annulus formed by the outside of the drill string and the borehole wall.

Bit hydraulics can be used to accomplish many different purposes on the hole bottom. Generally, a drill bit is configured with three cones at its bottom that are equidistantly spaced around the circumference of the bit. These cones are imbedded with inserts (otherwise known as teeth) that penetrate the formation as the drill bit rotates in the hole. Generally, between each pair of cones is a jet bore with an installed erosion resistant nozzle that directs the fluid from the face of the bit to the hole bottom to move the cuttings from the proximity of the bit and up the annulus to the surface. The placement and directionality of the nozzles as well as the nozzle sizing and nozzle extension significantly affect the ability of the fluid to remove cuttings from the bore hole.

The optimal placement, directionality and sizing of the nozzle can change depending on the bit size and formation type that is being drilled. For instance, in soft, sticky formations, drilling rates can be reduced as the formation begins to stick to the cones of the bit. As the inserts attempt to penetrate the formation, they are restrained by the formation stuck to the cones, reducing the amount of material removed by the insert and slowing the rate of penetration (ROP). In this instance, fluid directed toward the cones can help to clean the inserts and cones allowing them to penetrate to their maximum depth, maintaining the rate of penetration for the bit. Furthermore, as the inserts begin to wear down, the bit can drill longer since the cleaned inserts will continue to penetrate the formation even in their reduced state. Alternatively, in a harder, less sticky type of formation, cone cleaning is not a significant deterrent to the penetration rate. In fact, directing fluid toward the cone can reduce the bit life since the harder particles can erode the cone shell causing the loss of inserts. In this type of formation, removal of the cuttings from the proximity of the bit can be a more effective use of the hydraulic energy. This can be accomplished by directing two nozzles with small inclinations toward the center of the bit and blanking the third nozzle such that the fluid impinges on the hole bottom, sweeps across to the blanked side and moves up the hole wall away from the proximity of the bit. This technique is commonly referred to as a cross flow configuration and has shown significant penetration rate increases in the appropriate applications. In other applications, moving the nozzle exit point closer to the hole bottom can significantly affect drilling rates by increasing the impact pressures on the formation. The increased pressure at the impingement point of the jet stream and the hole bottom as well as the increased turbulent energy on the hole bottom can more effectively lift the cuttings so they can be removed from the proximity of the bit.

Unfortunately, modifications to bit hydraulics have generally been difficult to accomplish. Usually, bits are constructed using one to three legs that are machined from a forged component. This forged component, called a leg forging, has a predetermined internal fluid cavity (or internal plenum) that directs the drilling fluid from the center of the bit to the peripheral jet bores. A receptacle for an erosion resistant nozzle is machined into the leg forging, as well as a passageway that is in communication with the internal plenum of the bit. Typically, there is very little flexibility to move the nozzle receptacle location or to change the center line direction of the nozzle receptacle because of the geometrical constraints for the leg forging design. To change the hydraulics of the bit, it would be possible to modify the leg forging design to allow the nozzle receptacle to be machined in different locations depending on the desired flow pattern. However, due to the cost of making new forging dies and the expense of inventorying multiple forgings for a single size bit, it would not be cost effective to frequently change the forging to meet the changing needs of the hydraulic designer. In order to increase the ability of optimizing the hydraulics to specific applications, a more cost effective and positionally/vectorally flexible design methodology is needed to allow specific rock bit sizes and types to be optimize for local area applications.

The prior art has several examples of different attachable bodies used to improve the bit hydraulics. U.S. Pat. No. 5,669,459 (hereby incorporated by reference for all purposes) teaches the use of several different types of machined slots in the leg forging and a weldably attached body that mates to the machined slots and that directs the fluid from the interior plenum to the outside of the bit. One slot design allows the attachable body to be pivoted in one direction to radially adjust the exit vector of the nozzle. A second slot design uses a ball and socket type design that would allow the tube to be vectored both radially and laterally. However, in both of these designs it is difficult to align the vector angle, and both designs require costly fixtures to ensure the correct angle for the attached body. Furthermore, this type of slot is difficult and costly to machine. Moreover, the internal entrance to the weldable body is necessarily smaller than the machined opening of the slot to account for the variations in the nozzle body angles. This difference between the entrance to the attached tube and the machined slot opening creates a fluidic discontinuity in the path of the fluid from the center of the bit through the slot opening and into the tube. This discontinuity can cause turbulent eddy currents that can erode through the side wall of the bit causing premature bit failure. Such bit failures are unacceptable in drilling applications due to the high costs of drill bits and lost drilling time. A third slot design teaches a slot with only one orientation where the opening in the forging is closely matched to the entrance to the attachable body. This matched interface significantly reduces fluidic erosion increasing the reliability of the system. However, the slot does not include the ability to change the vector of the fluid system. This particular system directs the fluid parallel to the bit center line toward the hole bottom.

Consequently, it would be desirable to have a drill bit design that overcomes these and other problems.

BRIEF SUMMARY OF THE INVENTION

An embodiment of the invention is a drill bit having an internal fluid plenum and that defines a longitudinal axis, a nozzle retention body having an upper end for keyed attachment to the drill bit body and a lower end for retention of a nozzle, the upper end including a fluid inlet that is in fluid communication with the internal fluid plenum and the lower end defining a fluid exit flow angle. The fluid exit flow angle is angularly disposed from the longitudinal axis, and may include a lateral component or a radial component. The lower end preferably includes a smaller cross-sectional area than the region above it due, for example, to chamfering. The outermost portion of the nozzle retention body may extend to any desired degree, including short of the full diameter of the drill bit or to the full diameter of the drill bit. The drill bit may include nozzle retention bodies defining exit flow angles that are the same as, or differ from, each other. The nozzle retention bodies may also hold a nozzle that ejects drilling fluid at the exit flow angle of the nozzle retention body or at some different angle.

Alternately, the invention may be understood to be a method to form a nozzle retention body suitable for engagement to a drill bit including the step of manufacturing an unfinished nozzle retention body including an upper end and a lower end, the upper end forming an inlet that transitions into a flowbore and the step of machining a nozzle receptacle passage through said lower end portion and toward the flowbore, the nozzle receptacle passage being at an angle with respect to the longitudinal axis passing through the center of the nozzle receptacle. The machining of the nozzle receptacle passage may include drilling a counterbore into the lower end portion. The flowbore may include a pivot point at which the nozzle receptacle passage meets the flowbore. The unfinished nozzle retention body may also be chamfered at its lower end. The method may also include the step of mounting the upper end of the nozzle retention body into keyed relationship with the body of the drill bit, and the step of welding the nozzle retention body to the body of the drill bit.

BRIEF DESCRIPTION OF THE DRAWINGS

For a detailed description of a preferred embodiment of the invention, reference will now be made to the accompanying drawings wherein.

DETAILED DESCRIPTION OF THE PREFERRED EMBODIMENTS

Figure 1:
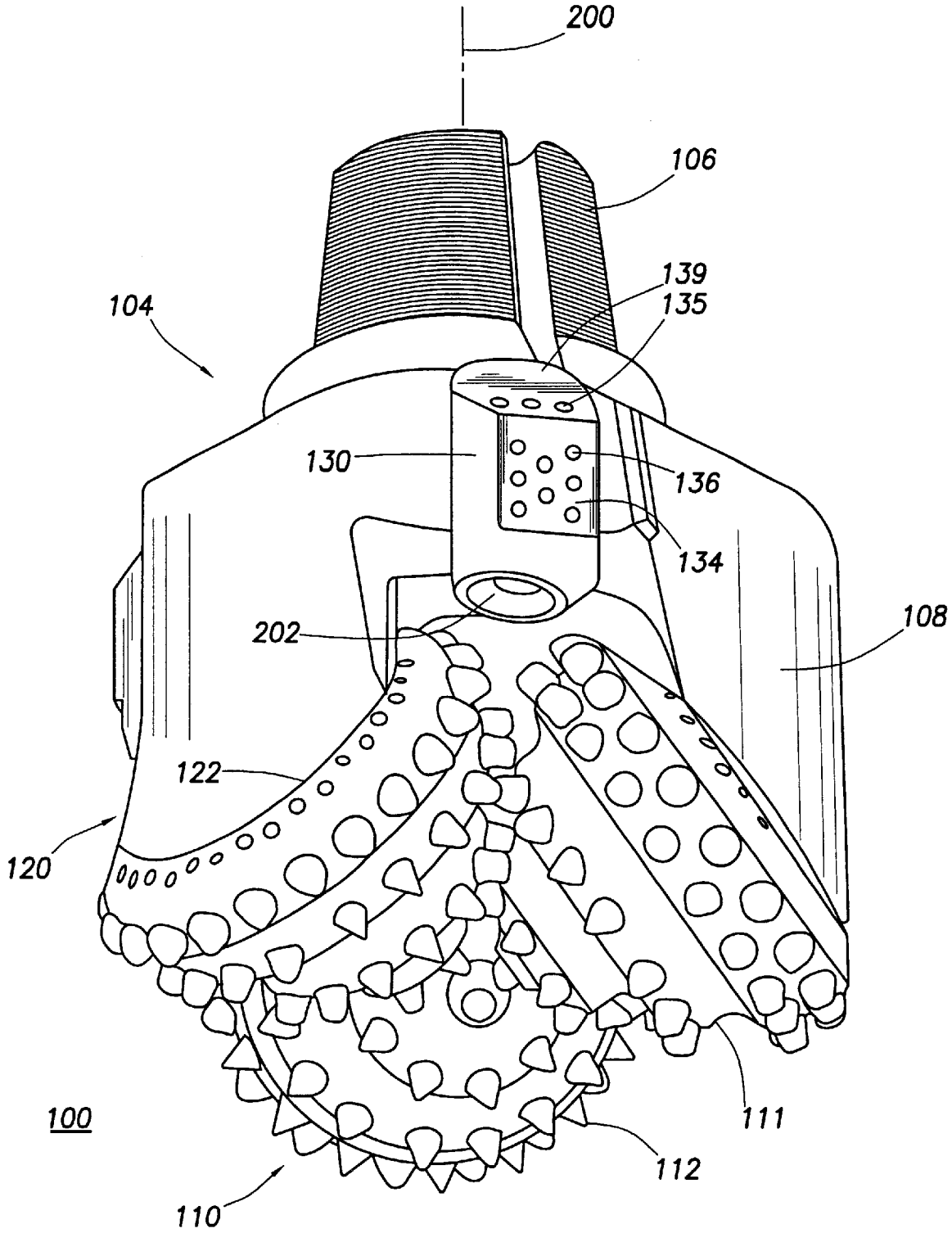
FIG. 1 is a perspective view of a rock bit with an angled nozzle retention body.

Referring to FIG. 1, a roller-cone bit in accordance with the preferred embodiment of the invention is shown. Roller cone bit 100 includes a body 102 and an upper end 104 that includes a threaded pin connection 106 for attachment of a drill string used to raise, lower, and rotate bit 100 during drilling. Drill bit body 102 forms an interior fluid chamber or plenum 13 (as shown in FIG. 2B) that acts as a conduit for drilling fluid that is pumped from the surface through an attached drill string. Body 102 includes a number of legs 108, preferably three with attached cutters 110. Each cutter 110 comprises a cone shell 111 and rows of cutting elements 112, or teeth. The teeth may be tungsten carbide inserts (TCI) or milled teeth, as is generally known in the art.

Bit body 102 and cutters 110 rotating on bearing shafts (not shown) define a longitudinal axis 200 about which bit 100 rotates during drilling. Rotational or longitudinal axis 200 is the geometric center or centerline of the bit about which it is designed or intended to rotate and is collinear with the centerline of the threaded pin connection 106. A shorthand for describing the direction of this longitudinal axis is as being vertical, although such nomenclature is actually misdescriptive in applications such as directional drilling.

Bit 100 includes directional nozzle retention bodies 130, also called directional Q-tubes, about its periphery preferably in locations defined between adjacent pairs of legs 108. Nozzle retention body 130 of bit 100 includes an inlet 230 (shown in FIG. 2B), an outlet nozzle receptacle 202 appropriate for insertion of a fluid nozzle, a lower load face 134, and an upper sloped portion 139. Load face 134 includes a plurality of apertures where hardened elements 136 are preferably installed. Other hardened elements 135 are located on the upper sloped portion 139 of nozzle retention body 130. Hardened elements can be made of natural diamond, polycrystalline diamond, tungsten carbide, or any other suitable hard material. They may also be of any suitable shape. The profile or load face 134 of the nozzle retention body 130 need not be straight, but may be tapered, curved, concave, convex, blended, rounded, sculptured, contoured, oval, conical or other. The hardened elements could also be replaced with a wear-resistant material that is weldably bonded to load face 134. The outer surface may also be off-gage (i.e. its outermost portion extends short of substantially the full diameter of the drill bit) or on-gage (i.e. its outermost portion extends to substantially the full diameter of the drill bit) in whole or in part, according to the downhole application.

Nozzle retention body 130 directs drilling fluid flow from the inner bore or plenum 13 of drill bit 100 in any desired angle. Thus, an important aspect of the preferred nozzle retention body is the angling of the outlet nozzle receptacle 202, as shown more clearly in FIGS. 2A and 2B. Because the vector angles of the nozzle outlet 202 can be vectored in any direction, the bit hydraulics can be directionally optimized to perform specific function with relative ease and low costs. For example, the vector angle may be directed radially outboard to the hole wall or radially inward to the center of the bit. The vector angle may also be a lateral vector angle toward the trailing cone or leading cone. The vector angle could be a combination of vectoring the nozzle receptacle both radially and laterally in a compound angle. Thus, in a sticky shale formation prone to bit balling the most advantageous angling of drilling fluid may be over the trailing side of a drill bit cone, resulting in enhanced cleaning of the cone surface. In a hard formation, chip removal is thought to be a primary concern, and thus the most advantageous angling of the drilling fluid may be over the leading side of the drill bit cone to enhance the flow of drilling fluid to the surface. Seal life may be improved if the fluid flow is directed to remove the buildup of formation from around the seal area 122. But regardless, given the incredible diversity of downhole variables such as weight on bit, revolutions per minute, mud type and weight, depth, pressure, temperature, and formation type, the ability to easily construct drill bits that can direct fluid from nozzle retention bodies at angles disposed from the longitudinal will be of great value to drill bit designers and engineers.

It is expected that the ability of drill bit designers to utilize a set of angled nozzle receptacles on a drill bit, with each nozzle receptacle canted at a different angle, will result in new designs and improvements in downhole cleaning from the ability to obtain consistent and desirable fluid flow patterns at the bottom of the wellbore. In fact, a set of variously angled directional nozzle retention bodies, combined with angled or non-angled nozzles and/or min-extended nozzles, promises to offer significant improvements in drill bit performance. To further enhance performance, the nozzle retention body 130 may be centered or offset closer to either the leading side or the trailing side of the leg.

Figure 2A:
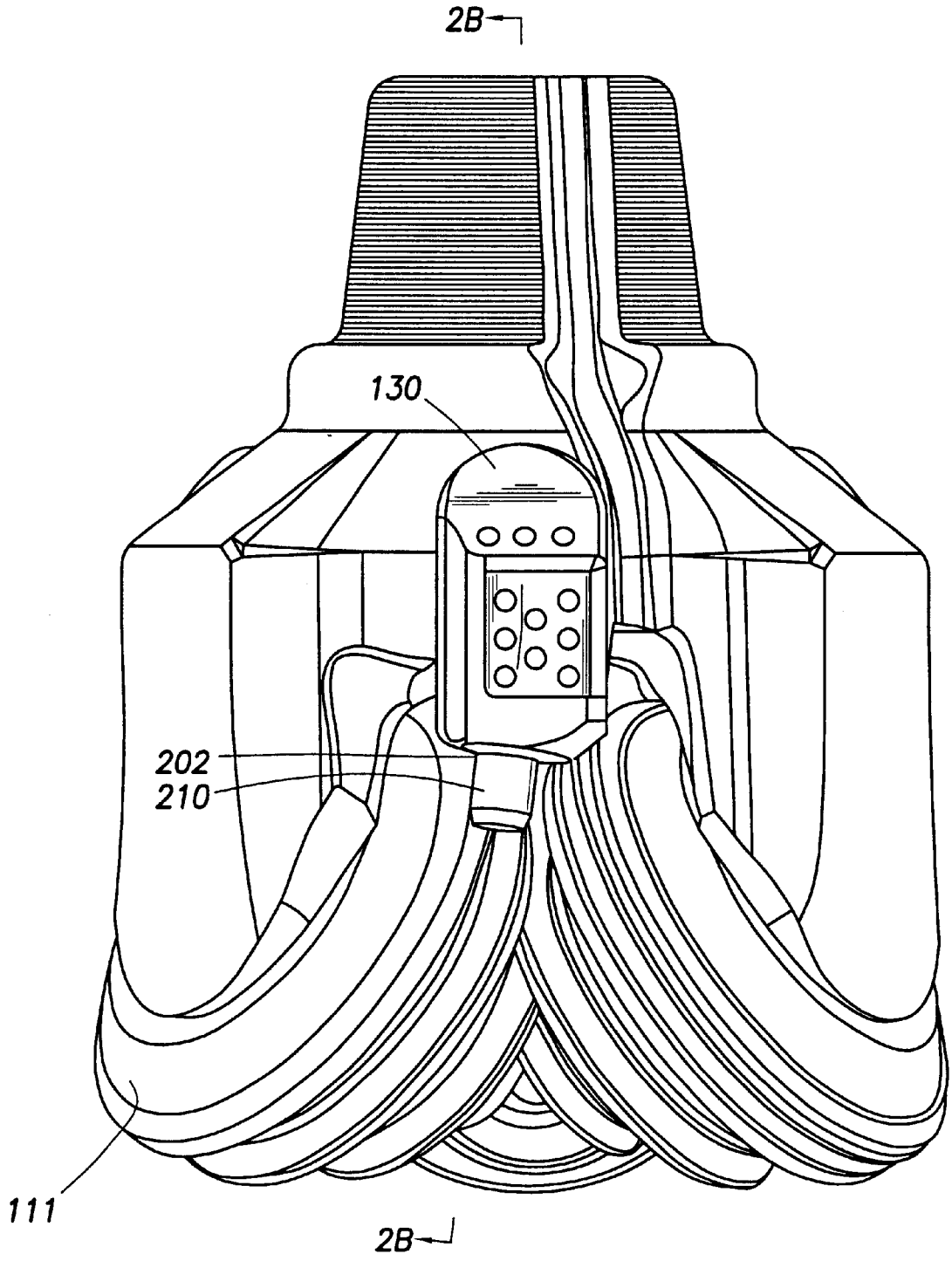
FIG. 2A is a perspective view of a rock bit with an angled nozzle retention body and a mini-extended nozzle.
Figure 2B:
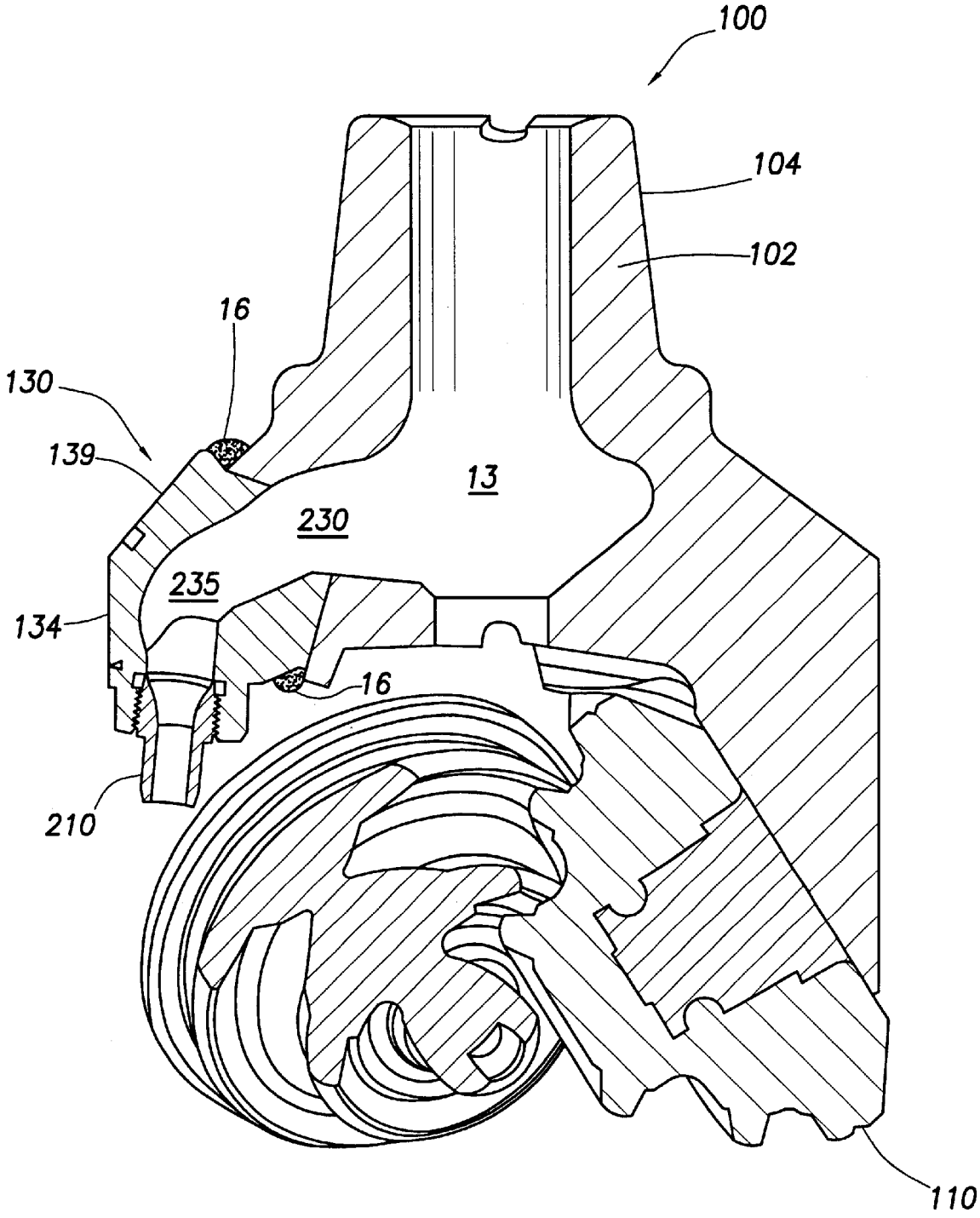
FIG. 2B is a cut-away view taken along line A—A of FIG. 2A.

FIG. 2A shows a drill bit with attached nozzle retention body 130. Mini-extended nozzle 210 is mounted in nozzle receptacle 202, and angles toward the trailing side of the cone shell 111. FIG. 2B is taken along line A—A of FIG. 2A.

FIG. 2B is a cross-sectional cut-away view of a nozzle retention body installed in the drill bit 100. The drill bit body 102 forms an interior fluid plenum 13 that transitions into the inlet 230 for the nozzle retention body 130. Nozzle retention body 130 includes an inner flowbore 235 that extends from the fluid inlet 230 to the nozzle 210. Nozzle retention body 130 retains a mini-extended nozzle 210 in the nozzle receptacle 202 by use of a nozzle retainer and o-ring, as is generally known in the field of mini-extended nozzles.

Since the nozzle retention body is relatively large, large streamlined passages may be formed in the body of the nozzle retention body. Further, because the nozzle retention body forms a part of the fluid plenum 13 in the drill bit, an enlarged streamlined opening internally of the weld interface is possible without major erosive discontinuities. The large passage and entrance to the nozzle retention body is desirable because it allows for greater fluid capacity by the nozzle retention body and reduces the erosion found in many previous fluid nozzles that have narrow fluid channels and sharp corners.

Figure 10:
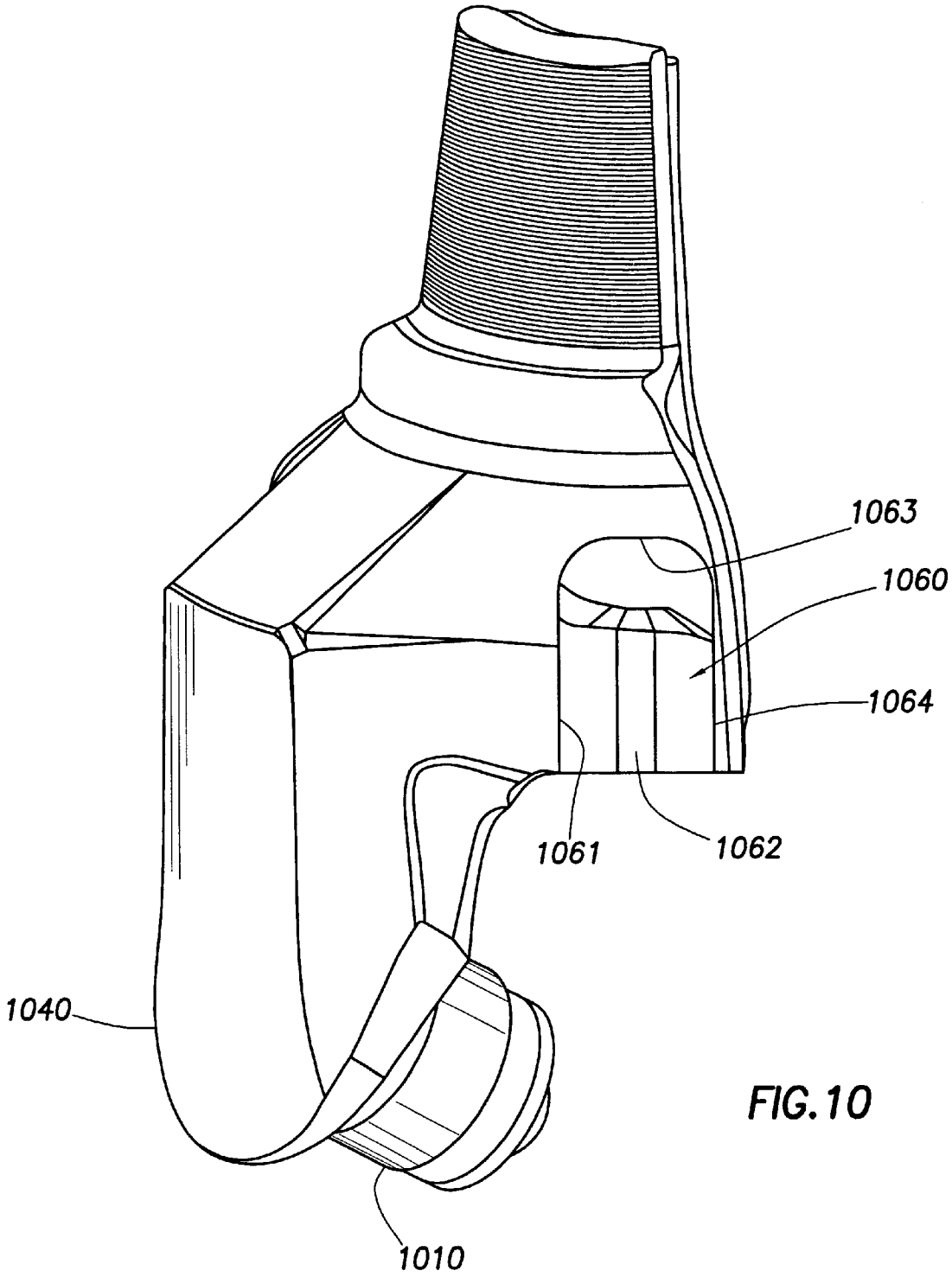
FIG. 10 is a partial drill bit body including a reception slot for a nozzle retention body.

FIG. 10 shows a drill bit leg 1040 with a machined journal 1010, and a reception slot 1060 for insertion of nozzle retention body 130 machined into a second drill bit leg. Nozzle retention body 130 mounts to rock bit body 102 by a keyed engagement that snugly holds the nozzle retention body 130 to the large receptive aperture 1060 in the rock bit body 102. As used herein, the term "keyed engagement" means a single orientation engagement. Consequently, in the preferred embodiment, the reception slot is machined into the leg and includes four orthogonal surfaces 1061–1064. Surfaces 1061, 1064 correspond generally to left and right surfaces, surface 1062 corresponds generally to a back surface, and surface 1063 corresponds generally to a top surface. Once the slot is machined into the leg, it is a simple process for the directional nozzle retention body to be welded to the drill bit in its intended position. Of course, other reception slot 1060 designs can be used as long as the nozzle retention body 130 and the reception slot 1060 are matched preferably for a "keyed engagement." Referring back to FIG. 2B, a weld line 16 therefore attaches the nozzle retention body to the rock bit body 102 after the nozzle retention body has engaged the drill bit. The long peripheral edge of the nozzle retention body allows a lengthy exterior weld to be used to attach the nozzle retention body to the drill bit body 102. This lengthy weld 16 securing the nozzle retention body to the drill bit body 102 results in a very high strength bond for the nozzle retention body, with a high resistance to breakage. An internal weld (not shown) may also be included, but is not thought to be necessary.

Figure 3A:
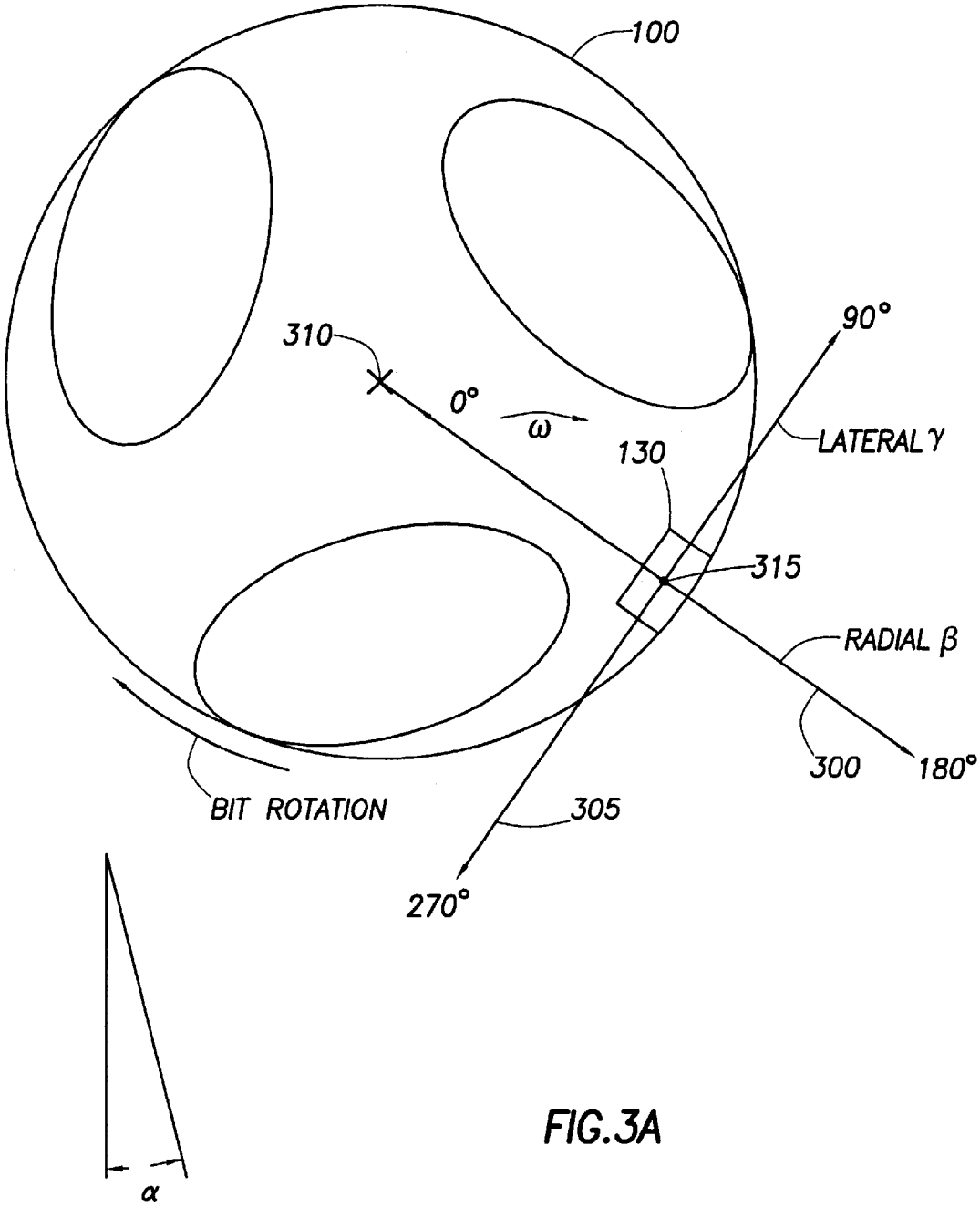
FIGS. 3A–3G are reference schematics defining directional angles for the nozzle receptacle.
Figure 3B:
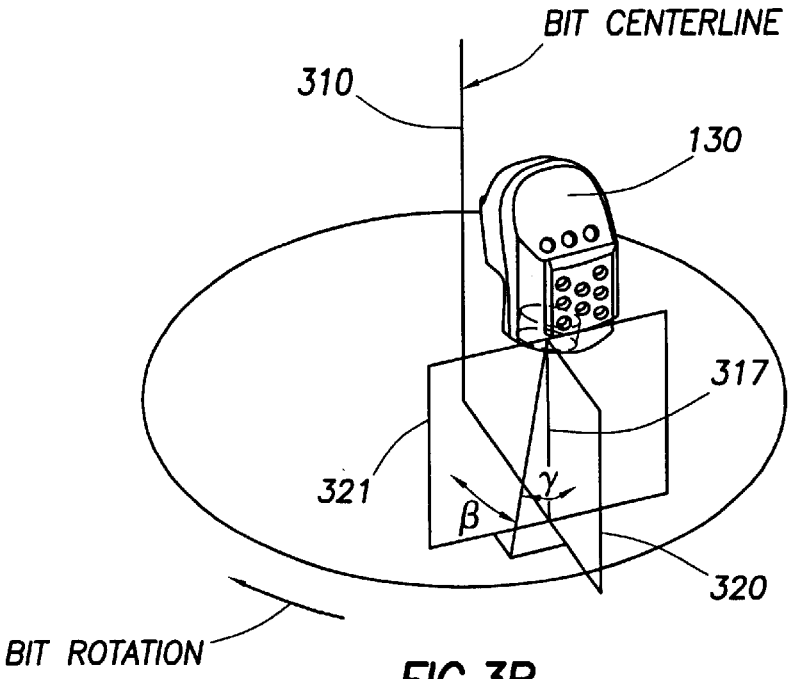

The exact direction of canting should also be defined. Referring to FIG. 3A, a topdown reference diagram is shown that defines the angular offset of nozzle receptacle 202. This diagram is not drawn to scale, but includes a drill bit 100 having three roller cones. Point 310 defines the centerline of drill bit 100, while point 315 defines the center of the nozzle receptacle at its exit. A reference line parallel to the longitudinal axis of the drill bit runs through point 315 and is called the nozzle receptacle centerline 317 (as shown in FIG. 3B). A radial reference line 300 defines the direction of the borehole wall directly away from the drill bit 100. A lateral reference line 305 is perpendicular to radial reference line 300. A lateral vector is positive when it points generally in the direction of bit rotation and generally toward the leading cone. Conversely, a lateral vector is negative when it points generally against the direction of bit rotation and toward the lagging cone. Radial reference line intersects point 310 in the center of the drill bit 100, and intersects a lateral reference line at point 315. A radial vector is positive when it points outward, toward the borehole wall. A radial vector is negative when it points inward toward the bit centerline. Thus, each canting or direction of the nozzle receptacle 202 may be defined as being some combination of a radial vector and a lateral vector.

Figure 3C:
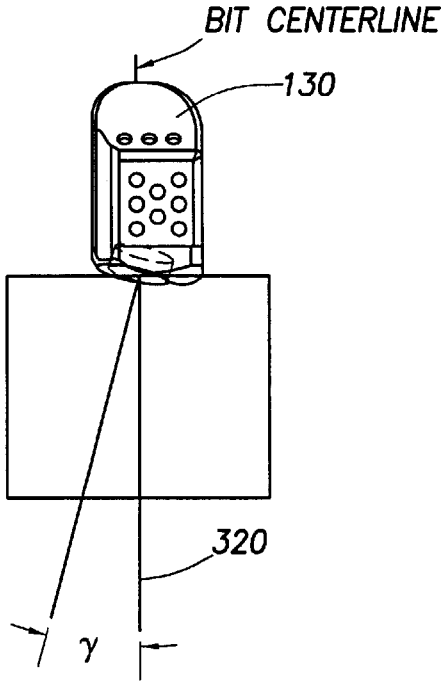
Figure 3D:
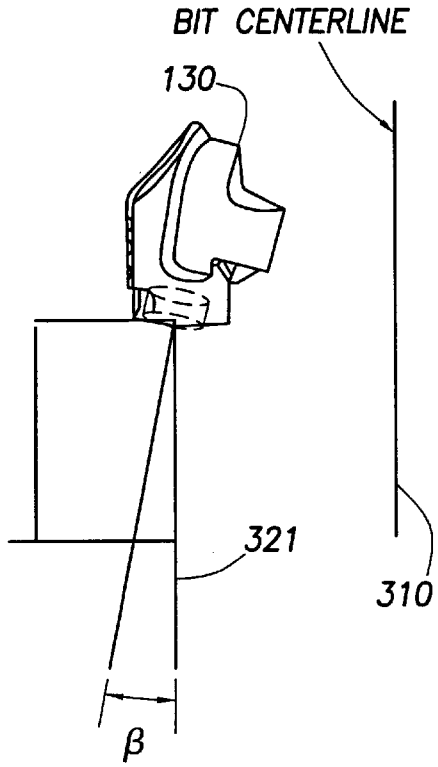

One example of this is shown in FIGS. 3B–3D. A nozzle retention body 130 is shown in FIG. 3B, with the direction of its nozzle being defined by two vector angles, $\gamma$ and $\beta$. Referring to FIGS. 3B and 3C, the angle $\gamma$ is a lateral angle defined with respect to a first plane 320. Plane 320 is formed by the bit centerline 310 and the nozzle receptacle centerline 317. In other words, the true angle $\gamma$ may be referenced from a straight ahead view of the nozzle retention body 130 as shown in FIG. 3C. Positive $\gamma$ angles direct the fluid in direction of rotation of the bit while negative $\gamma$ angles direct the fluid against the rotation of the bit. A $\gamma$ angle of zero degrees directs the fluid within the radial reference plane 320.

Referring now to FIGS. 3B and 3D, the angle $\beta$ is defined by a second plane 321 that lies perpendicular to the first plane 320 and that intersects the first plane at 317, the nozzle receptacle centerline. In other words, the angle may be referenced from the side view of the nozzle retention body shown in FIG. 3D. Positive $\beta$ angles direct the fluid in the direction of hole wall while negative $\beta$ angles direct the fluid toward the center of the bit. A $\beta$ angle of zero degrees directs the fluid within the lateral reference plane 321. When both the $\gamma$ and $\beta$ angles are zero degrees, the drilling fluid is directed parallel to the center line of the bit toward the hole bottom. A $\gamma$ angle range ±60 degrees and a $\beta$ angle range of −90 to +60 degrees can improve bottom hole cleaning by giving the bit designer the ability to direct the jet direction under the bit. A $\gamma$ angle of 110 to 250 degrees can provide improved cuttings removal by directing the fluid with a vector component moving toward the surface. This type of configuration is commonly known in the industry as an upjet. Angled upjets may have the benefit of optimizing the jet direction with the rotation of the bit such that the cuttings are more optimally removed from the proximity of the bit. While these vector angles have benefit based on current design philosophies, other angles certainly may show benefit in the future. As such, a major benefit of this attachable body design is that the angles can be readily changed to meet the future needs of the engineers without large impacts on the leg forgings.

Referring back to FIG. 3A, alternately, the direction and magnitude of the nozzle receptacle may be defined in a conical coordinate system as a combination of two angles, $\omega$ and $\alpha$. Referring to the radial reference line 300, an angle $\omega$ of 0° lies toward the center of the drill bit, with an angle $\omega$ of 180° lying in the direction of the borehole wall. An angle $\omega$ of 90° points in a direction collinear with the lateral reference line in a direction generally toward the lagging cone of a three cone rock bit. Likewise, an angle $\omega$ of 270° lies collinear with the lateral reference line in a direction generally toward the leading cone. The severity of the canting in a particular direction is defined by the second angle, $\alpha$. Angle $\alpha$ is defined with respect to the nozzle receptacle centerline, a vertical (i.e. parallel to the longitudinal axis of the drill bit) axis of the nozzle retention body running through point 315, the center of the nozzle receptacle. The nozzle receptacle centerline may also be referred to as the fluid outlet centerline.

Figure 3E:
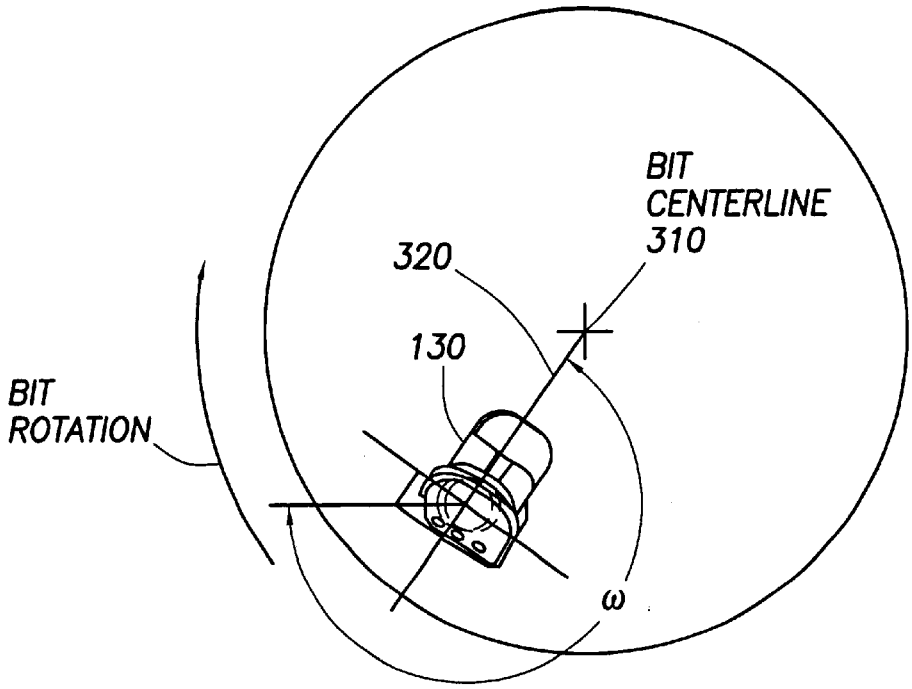
Figure 3F:
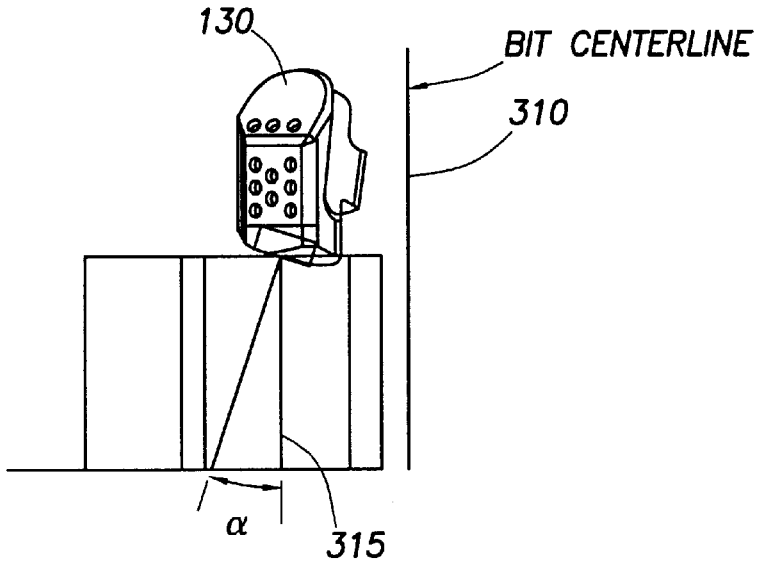
Figure 3G:
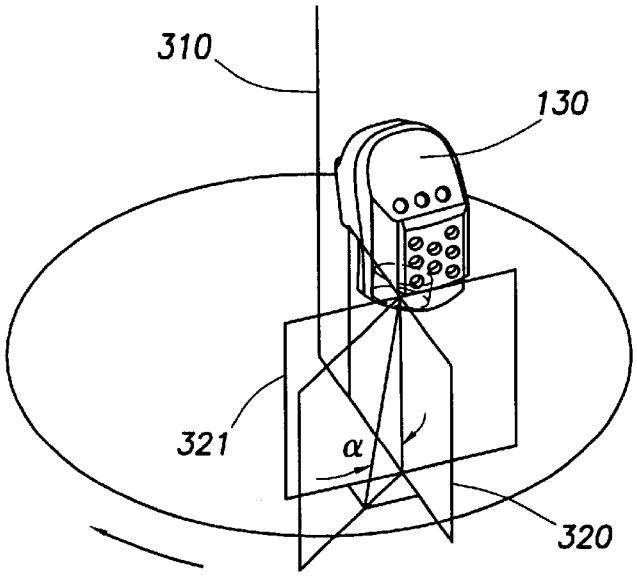

One example of this is shown in FIGS. 3E–3G. A nozzle retention body 130 is shown in FIG. 3A, with the direction of its nozzle being defined by two angles, $\omega$ and $\alpha$. Referring to both FIGS. 3A and 3E, the angle $\omega$ is defined with respect to the first plane 320 formed by the bit centerline and the centerline of the nozzle receptacle. In other words, the angle $\omega$ may be referenced from a top down view of the nozzle retention body 130 as shown in FIG. 3E. Referring to both FIGS. 3A and 3F, the angle a is defined by how far the nozzle receptacle 202 is canted or angled away from the nozzle receptacle centerline that is parallel to the bit centerline. FIG. 3G shows the combination of these two angles.

Figure 4:
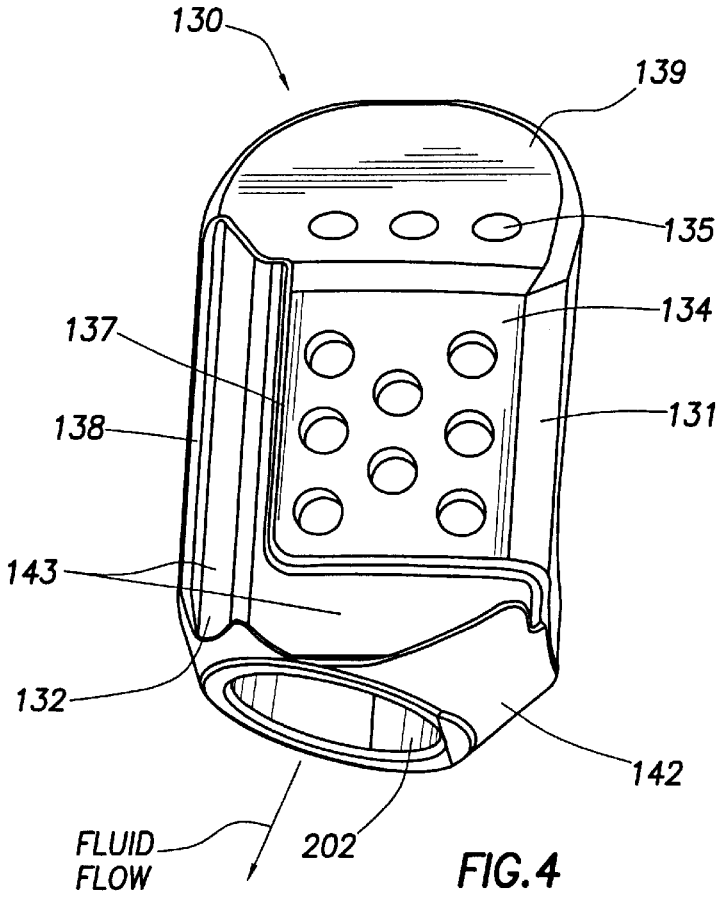
FIG. 4 is a close up view of a directional nozzle retention body.

Referring to FIG. 4, a close-up front view of nozzle retention body 130 is shown. Load face 134 is elevated from the remainder of nozzle retention body 130 as indicated by ledge 137. Nozzle retention body area 139 slopes away from load face 134 toward the body of the drill bit as shown in FIG. 1. Recessed area 143 is typically filled with an abrasion resistant material such as tungsten carbide or impregnated diamond to protect the nozzle retention body 130 during drilling operations. Ledges 138 and 137 provide a guide for the application of the erosion resistant material. Generally rounded surface 131 is machined on the lagging face of nozzle retention body 130, with welding ledge 138 and sloped area 132 being manufactured on the leading face of nozzle retention body 130. Because sloped area 132 is on the leading edge, sloped area 132 is preferably covered with hard facing to resist wear. Outlet nozzle receptacle 202 directs drilling fluid flow away from the nozzle retention body at an angle from longitudinal. The area proximate the outlet nozzle receptacle 202 is referred to as the nozzle retention body end 142 and may be chamfered, shaped, or contoured to provide reasonable clearance between the cutting structure and the nozzle retention body. This reduction in cross sectional area at the nozzle retention body end 142 allows the nozzle retention body end to extend closer to the wellbore bottom. This also allows a nozzle in nozzle receptacle 202 to be closer to the hole bottom while still maintaining the strength and robustness of the nozzle retention body.

Figure 5:
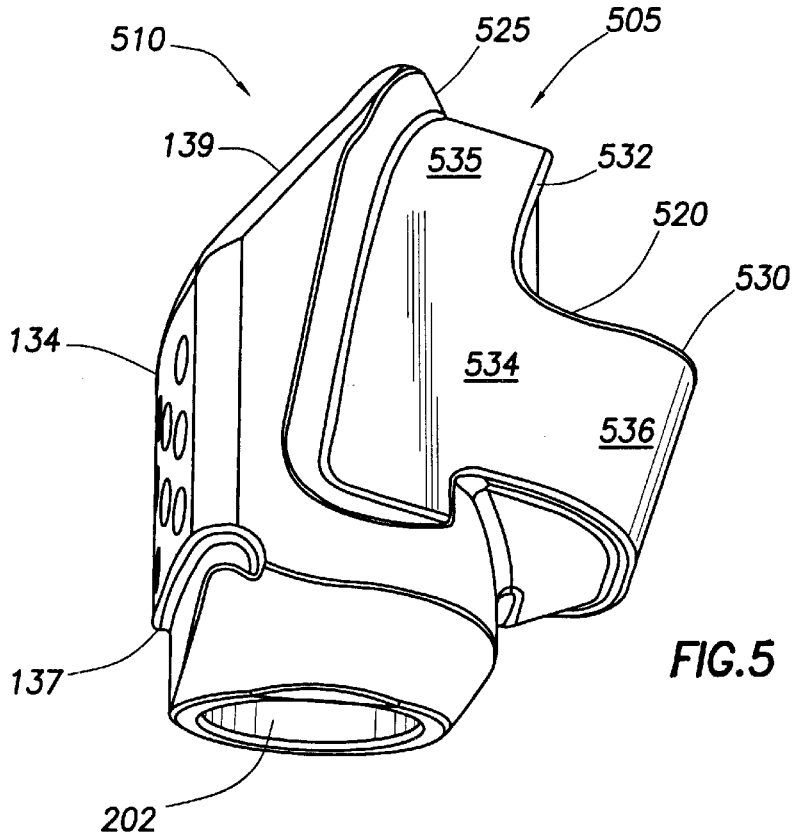
FIG. 5 is a side view of a directional nozzle retention body.

FIG. 5 is a side view of a nozzle retention body 130 separate from a drill bit. It generally includes an interior area 505 for insertion into the drill bit body 102, and an exterior portion 510 that remains outside the drill bit 100. Interior area 505 includes inlet 520 suitable as an entrance for drilling fluid from the plenum 13 of the drill bit 100. Inlet 520 is preferably defined by orthogonal lip surfaces 530 and 532. Flat surface 534 is preferably perpendicular to lip surfaces 530 and 532, and transitions into curved areas 535 (top) and 536 (rear). After insertion into the receptacle slot 1060, flat surface 534 and a corresponding flat surface (not shown in FIG. 5) on the opposite side of the nozzle retention body engage with surfaces 1061, 1064.

Exterior portion 510 includes load face 134 elevated by ledge 137, angled face 139 and a nozzle receptacle 202 for receiving the outlet nozzle. Nozzle retention body interface 525 connects the interior portion 505 and the exterior portion 510 of the nozzle retention body 130. Nozzle retention body interface 525 and curved areas 535 and 536 form the hard surfaces that abut the drill bit body when nozzle retention body is inserted into the drill bit 100.

Figure 6:
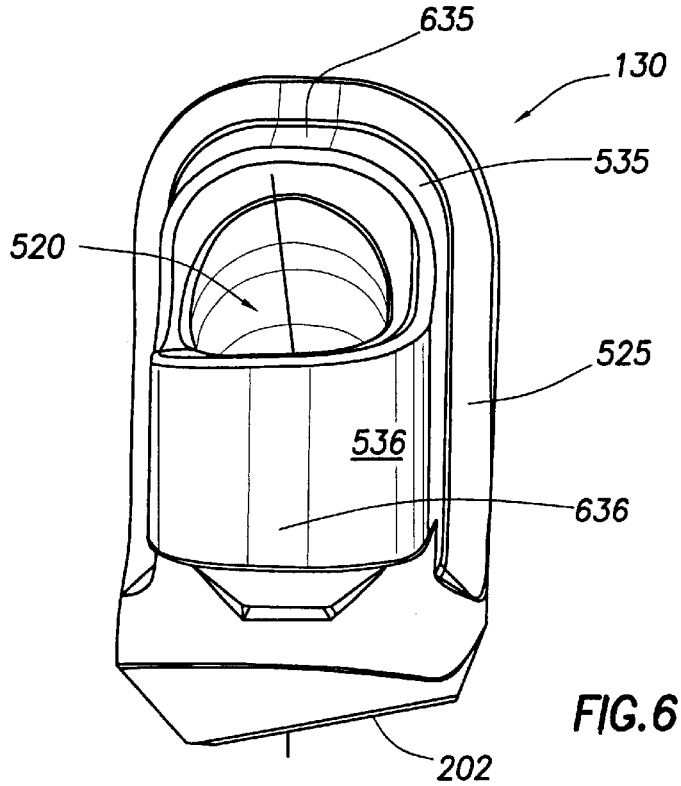
FIG. 6 is a rear view of a directional nozzle retention body.

FIG. 6 is a rear view of directional nozzle retention body 130. While depicting elements of the nozzle retention body such as surfaces 525 and 536, and nozzle receptacle 202, its most noticeable feature is the large inlet chamber 520. The size of this inlet chamber 520 reduces fluid turbulence and increases drill bit performance. Also shown are flat surfaces 635 and 636. Curved area 535 transitions into flat surface 635 at the top of the nozzle retention body. flat surface 635 engages with reception slot top surface 1063 upon the engagement of the nozzle retention body into the reception slot 1060. Curved area 536 transitions into flat surface 636 at the back of the nozzle retention body. Flat surface 636 engages with reception slot rear surface 1062 upon the engagement of the nozzle retention body into the reception slot 1060. Each of surfaces 635 and 636 are preferably perpendicular to surface 534 shown in FIG. 5.

Once the slot is machined into the leg, it a simple process for the Q-tube to be welded in the bit in its correct position. This will be especially beneficial at the local drilling areas where local machine shops can machine the slot on a finished bit and weld the Q-tube in position with a high confidence the nozzles are directed at the correct location on the bit. Many other types of slot designs could be used. The only criterion is that the slot should key or fix the position of the attachable body to the leg such that the vectored fluid passage within the confines of the attached body are directed to their prescribed locations.

One benefit of the nozzle retention body 130 as shown in the Figures is that the opening formed in the drill bit body 102 if much larger than the drilled bore used when drilling the nozzle receptacle directly into the leg forging. The reduced cross-section of the standard nozzle receptacle is more susceptible to fluidic erosion, and has erosion-prone discontinuities, since the fluid accelerates into the reduced area of the jet bore created erosive eddy currents. Since the nozzle retention body forms a portion of the plenum chamber and the pathway 235 from the plenum 13 to the nozzle 210 inlet is generally continuous, the erosive eddy currents are minimized greatly reducing fluid erosion of the steel. Further, the nozzle retention body as shown has a keyed engagement between the nozzle retention body and the drill bit body. This simplifies the welding of the nozzle retention body 130 to the drill bit body 102.

Nozzle retention body 130 is preferably manufactured of a high strength material with good wear resistance for long life and durability. Nozzle retention bodies 130 may include enhancements such as hard facing or additional diamond cutter surfaces to improve overall performance of bit 100. Such hard facing can improve overall bit performance and reduce the possibility for nozzle retention body washout. Furthermore, nozzle retention body 130 flushes cuttings away from borehole bottom more effectively than before. Because of its massive construction and the chamfering or machining of its end, nozzle retention body 130 is able to relocate the nozzle receptacle 202 closer to borehole bottom without the worry or threat of breaking when impacted with high energy formation cuttings. The improvements mentioned above enable the useful life to drill bit 100 to be extended and can increase the effective rate of penetration when drilling wells.

Another advantage to the preferred nozzle retention body is its economical method of manufacture. It is preferred that the master casting mold of nozzle retention body 130 be manufactured without defining the specifics of the directional flowbore so that individualized nozzle retention bodies 130 can be manufactured for specific applications. This reduces the cost of manufacturing the directional nozzle retention body and allows for a wide range of angles.

Figure 7A:
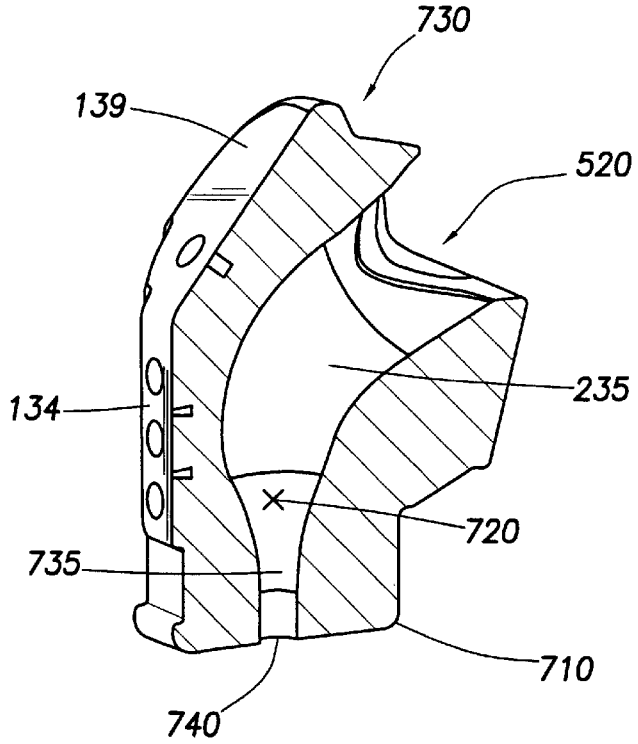
FIG. 7A is a side cut-away view of an unfinished nozzle retention body.
Figure 7B:
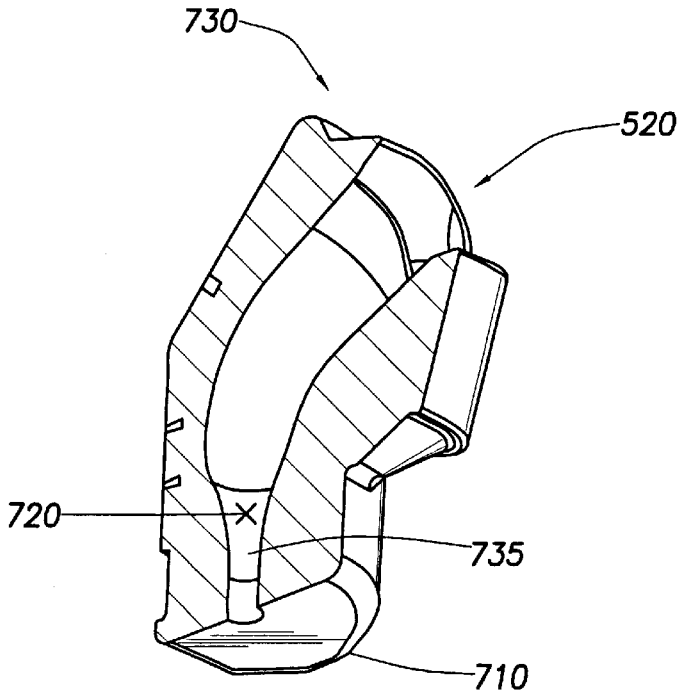
FIG. 7B is a side-bottom view of the unfinished nozzle retention body of FIG. 7A.

FIGS. 7A and 7B show a cross-section of an unfinished nozzle retention body 730 prior to any counterboring. Nozzle body receptacle 130 includes load face 134 and sloped area 139, as well as large inlet entrance 520 and the upper portion of the inner flowbore 235. However, as the inner flowbore transitions toward the lower end 710 of the generic nozzle retention body 730, it narrows into passage 735. Passage 735 also includes an "X" in its length, indicating the approximate location of a "pivot point" 720. Passage 735 continues down to an exit hole 740 at the lower end 710 of the of unfinished nozzle retention body. As will be understood below, it is not essential to the invention that passage 735 continue below the pivot point 720 because the nozzle receptacle will be drilled into the unfinished nozzle retention body in any case. However, its presence may be desirable for manufacturing or other purposes. In addition, the lower end 710 of the generic nozzle retention body 730 is not yet chamfered and has a large, bulky profile.

Figure 8:
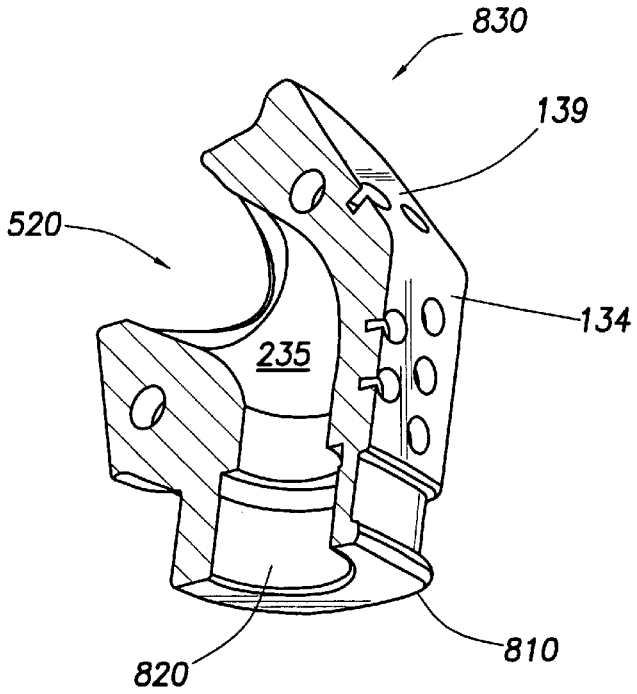
FIG. 8 is a side cut-away view of a nozzle retention body including an angularly disposed nozzle receptacle.
Figure 9:
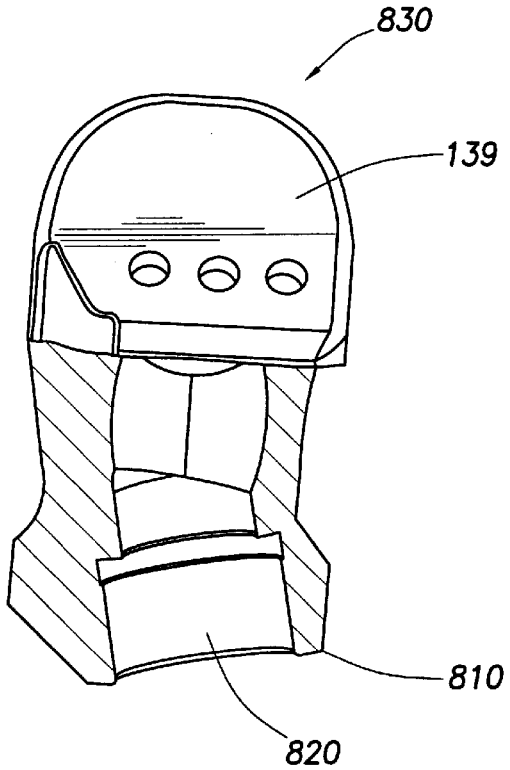
FIG. 9 is a front cut-away view of a nozzle retention body including an angularly disposed nozzle receptacle.

Referring to FIG. 8, a nozzle retention body 830 includes a large inlet entrance 520 proximate its upper end that transitions into a flowbore 235 and a nozzle receptacle passage 820 at the lower end 810. The generic nozzle retention body 730 of FIG. 7 is transformed into the nozzle retention body of FIG. 8 by means of counterboring a nozzle receptacle passage 820 into the lower end of the nozzle retention body. This counterbored passage 820 may be at any angle in a pre-selected range, but must intersect passage 235 to facilitate fluid flow. The necessary intersection of the counterbored nozzle receptacle and the passage 235 is expected to be accomplished by drilling toward the pivot point 740 until the two passages connect. The pivot point 740 is not necessarily an exact point, and indeed will vary slightly from nozzle retention body to nozzle retention body. Instead, it is a generalized universal target in passage 235, regardless of the angle of the counterbored passage. Of course, the counterbored passage 820 may be machined to the lower end 810 of the unfinished nozzle retention body by one or more than one steps, and there is not a specific need to have a universal pivot point pre-defined in the passage 235 (although this is expected to simplify manufacture of differently angled nozzle receptacles). Nonetheless, to simplify manufacturing a target pivot point 740 is expected to be pre-determined, and may be found with relative precision on any particular generic nozzle retention body 730 by use of the perpendicular surfaces 530, 532, and 534. FIG. 9 shows the counterbored passage 820 canted at an angle to vertical.

An important feature of making the unfinished nozzle retention body be generic for a large range of angles is leaving sufficient mass at the base 810 of the nozzle retention body 730. It is only after the counterbore is drilled that the end of the nozzle retention body is chamfered or otherwise altered to minimize space requirements while maximizing strength.

While it would be most cost effective to use a single casting for all vector angles, the ranges of angles for a particular casting is limited by how the machined bore 820 and the cast bore 235 intercept each other. To cover a maximum range of angles, multiple casting may be required with each casting have a pre-defined range of lateral and radial angles that can be used to define the nozzle vector angle. However, with only a few castings, a broad range of nozzle vector angles can be accomplished providing a broad range of flexibility to the design engineer. The nozzle retention body may be of any length as long as it conforms to the interface 525 and fits within the design envelope of the bit body 102.

It is expected that the upper end of the unfinished nozzle retention body 730 will be manufactured for a keyed engagement with a drill bit 100. In particular, it is envisioned that a variety of different nozzle retention bodies 130 having different angled outlets may be brought to a drill site. Accompanying this array of nozzle retention bodies would be one or more drill bit bodies with suitable openings or apertures for receiving nozzle retention bodies, but with the nozzle retention bodies as yet uninstalled. Depending on the particular conditions in the borehole, particular nozzle retention bodies may be selected and welded to the drill bit on-site. Because a keyed mounting is preferred, the welding process is simplified and error in the exact exit flow angle for a nozzle retention body is much less likely. This results in an external weld of sufficient strength to withstand downhole forces. An interior weld may be added if, for example, the to the nozzle retention body is mounted before assembly of the legs of the drill bit. The flexibility to assemble a tailored drill bit on-site is thought to be highly desirable given the unpredictability of conditions downhole.

Nonetheless, this method of manufacturing a nozzle retention body 130 having an angled nozzle retainer 220 could be applied to nozzle retention bodies having engagements other than keyed, such as rotating or ball-and-socket-like engagements because a beauty of this method of manufacture is the machining of a nozzle receptacle in the lower end of the generic and unfinished nozzle retention body. As explained above, however, the keyed attachment for the nozzle retention body is preferred.

Thus, the preferred embodiment of the invention overcomes many of the problems of the prior art by using a weldably (or otherwise) attachable body and a machined slot in the bit body that allow the attachable body to be placed in the bit in only one orientation. The nozzle receptacle machined in the attachable body or Q-tube is drilled at an angle providing the flexibility to change the directionality and placement of the nozzle centerline and exit bore. A special casting is designed that allows for the nozzle receptacle to be machined into the attachable body with a broad range of vector angles to account for the application specific requirements while keeping the installation of the Q-tube the same for all (since the interface slot has not changed and positionally fixes or keys the attachable body in the leg).

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

What is claimed is:

1. A roller cone drill bit, comprising:

a drill bit body defining a longitudinal axis and an internal fluid plenum for allowing fluid to pass through;

a nozzle retention body having an upper end for keyed attachment to said drill bit body and a lower end for retention of a nozzle, said upper end including a fluid inlet that is in fluid communication with said internal fluid plenum when said nozzle retention body is attached to said drill bit body, and said lower end including a fluid outlet that defines an exit flow angle;

an interior channel from said fluid inlet to said fluid outlet;

wherein said exit flow angle is angularly disposed from a fluid outlet centerline that lies parallel to said longitudinal axis and that intersects the center of said fluid outlet.

2. The drill bit of claim 1, wherein said exit flow angle includes a lateral component.

3. The drill bit of claim 1, wherein said exit flow angle includes a radial component.

4. The drill bit of claim 1, wherein said lower end has a smaller cross-sectional area than a region above said lower end.

5. The drill bit of claim 1, wherein said lower end is chamfered.

6. The drill bit of claim 1, wherein said drill bit body has a full diameter, the outermost portion of said nozzle retention body extending short of said full diameter.

7. The drill bit of claim 1, wherein said drill bit body has a full diameter, the outermost portion of said nozzle retention body extending to said full diameter.

8. The drill bit of claim 1, wherein said drill bit includes at least two nozzle retention bodies, said first nozzle retention body having a first exit flow angle and said second nozzle retention body having a second exit flow angle, said first exit flow angle being different from said second exit flow angle.

9. The drill bit of claim 1, wherein said fluid outlet is a nozzle receptacle holding a nozzle, and said fluid is ejected from said nozzle at said exit flow angle.

10. The drill bit of claim 1, wherein said fluid outlet is a nozzle receptacle engaged with a nozzle, and said fluid is ejected from said nozzle at an angle different from said exit flow angle.

11. The drill bit of claim 1, wherein said drill bit includes a plurality of adjacent legs, said nozzle retention body being mounted closer to one of said plurality of adjacent legs than to another.

12. The roller cone rock bit of claim 1, wherein a transition from said internal fluid plenum to said fluid inlet is free from erosion-prone discontinuities.

13. The roller cone rock bit of claim 1, wherein said exit flow angle is defined by vector angle $\gamma$ and vector angle $\beta$, vector angle $\gamma$ being measured by reference to a first plane formed by said longitudinal axis and by a point defined by the intersection of said fluid outlet centerline and the exit face of said nozzle receptacle, and vector angle $\beta$ being measured by reference to a second plane formed by a point defined by the intersection of said fluid outlet centerline and the exit face of said nozzle receptacle and lying perpendicular to said first plane.

14. The roller cone rock bit of claim 13, wherein $\gamma$ is between −60 degrees and 60 degrees inclusive.

15. The roller cone rock bit of claim 13, wherein is $\beta$ between −90 degrees and 60 degrees inclusive.

16. The roller cone rock bit of claim 14, wherein is $\beta$ between −90 degrees and 60 degrees inclusive.

17. The roller cone rock bit of claim 13, wherein $\gamma$ is between 100 degrees and 250 degrees inclusive.

18. The drill bit of claim 1, wherein said nozzle retention body is welded to said roller cone drill bit.

19. The drill bit of claim 1, wherein said fluid inlet of said nozzle retention body is attached to said internal fluid plenum of said drill bit body to form a transition surface from said internal fluid plenum to said fluid inlet, said transition surface being streamlined.

20. The drill bit of claim 19, wherein said transition surface is internal of a weld between said nozzle retention body and said drill bit body.

21. The drill bit of claim 6, said nozzle retention body including a load face, said load face having one or more hardened elements.

22. The drill bit of claim 7, said nozzle retention body including a load face, said load face having one or more hardened elements.

23. The roller cone drill bit of claim 1, further comprising:

a nozzle inserted into said lower end of said nozzle retention body, wherein said nozzle has a central axis and said nozzle is configured to direct drilling fluid in a direction parallel to said central axis.

24. The roller cone drill bit of claim 1, further comprising:

a nozzle inserted into said lower end of said nozzle retention body, wherein said nozzle has a central axis and said nozzle is configured to direct drilling fluid in a direction not parallel to said central axis.

25. A method for directing a flow of drilling fluid from a drill bit, comprising:

a) engaging a nozzle retention body in an aperture of a drill bit, said aperture connecting to an interior fluid plenum of the drill bit, wherein said nozzle retention body includes a central axis and an exit opening for attachment of a nozzle, said exit opening being disposed at a non-parallel angle from said central axis;

b) affixing said nozzle retention body to said drill bit;

c) attaching a drilling fluid nozzle to said nozzle retention body, wherein said drilling fluid nozzle is an angled nozzle.

26. A method for directing a flow of drilling fluid from a drill bit, comprising:

a) engaging a nozzle retention body in an aperture of a drill bit, said aperture connecting to an interior fluid plenum of the drill bit, wherein said nozzle retention body includes a central axis and an exit opening for attachment of a nozzle, said exit opening being disposed at a non-parallel angle from said central axis;

b) affixing said nozzle retention body to said drill bit;

c) attaching a drilling fluid nozzle to said nozzle retention body;

d) engaging a second nozzle retention body in a second aperture of said drill bit, said second aperture connecting to said interior fluid plenum, wherein said second nozzle retention body includes a central axis and an exit opening for attachment of a nozzle, said exit opening being disposed at a non-parallel angle from said central axis;

e) affixing said second nozzle retention body to said drill bit;

f) attaching a second drilling fluid nozzle to said second nozzle retention body, wherein said first nozzle and said second nozzle direct drilling fluid at different angles relative to said first nozzle retention body and said second nozzle retention body, respectively.

* * * * *